United States Patent [19]

Suszynski

[11] 4,325,050

[45] Apr. 13, 1982

[54] CONTROL STICK ASSEMBLY

[75] Inventor: Edward D. Suszynski, Vista, Calif.

[73] Assignee: Kraft Systems, Inc., Vista, Calif.

[21] Appl. No.: 214,439

[22] Filed: Dec. 8, 1980

[51] Int. Cl.[3] ..... H01C 10/16

[52] U.S. Cl. ..... 338/128; 74/471 XY

[58] Field of Search ..... 338/128, 129; 74/471 XY; 137/636.2

[56] References Cited

U.S. PATENT DOCUMENTS

| | | | |
|---|---|---|---|
| 3,870,161 | 3/1975 | Cording | 74/471 XY X |
| 4,042,902 | 8/1977 | Meyer et al. | 338/128 |
| 4,101,863 | 7/1978 | Lewicki | 338/128 |
| 4,275,611 | 6/1981 | Asher | 338/128 X |

FOREIGN PATENT DOCUMENTS

GM7829428 1/1979 Fed. Rep. of Germany .

*Primary Examiner*—C. L. Albritton

*Attorney, Agent, or Firm*—Christie, Parker & Hale

[57] ABSTRACT

A control stick assembly has a crank coupling the control stick to the input shaft of one potentiometer and a bail coupling the control stick to the input shaft of the other potentiometer. There are no other connections between the control stick and the remainder of the assembly to bear loads exerted on the control stick. The bail furnishes mechanical stability to the control stick support because it is connected to the housing of the assembly at two places on either side of the control stick. This eliminates the cantilever effect of the control stick support without substantially increasing the number of parts or design complexity.

10 Claims, 4 Drawing Figures

CONTROL STICK ASSEMBLY

BACKGROUND OF THE INVENTION

This invention relates to signal generating devices and, more particularly, to a control stick assembly for generating electrical signals representative of the coordinates of control stick displacement.

Miniature control sticks have been used for a number of years to generate electrical input signals in radio control systems for model airplanes, cars, boats, etc. Such miniature control sticks have also been put to other uses requiring generation of coordinate electrical signals responsive to a manual input.

In the described control stick assembly, displacement of the control stick along two orthogonal axes is coupled to orthogonally disposed input shafts of two potentiometers. Until recently, the control stick has usually been coupled to the potentiometer input shafts by gimbals. Each gimbal has a slot that captures the control stick. As the control stick moves, the gimbals rotate responsive thereto and turn the potentiometer input shafts. The gimbals are not load bearing members—loads exerted on the control stick are transferred directly to the control panel.

German utility model No. GM-78 29 428 discloses a control stick assembly in which the control stick is coupled to the potentiometer input shafts by load bearing cranks, rather than gimbals; which results in a simplification of design and fewer parts. All the support for the control stick is provided by the cranks. The control stick is effectively cantilevered from the ends of the potentiometer input shafts, leading to mechanical instability of the control stick support. The control stick feels to the user as though it is floating, which is a disconcerting sensation.

SUMMARY OF THE INVENTION

According to the invention, a control stick assembly has a crank coupling the control stick to the input shaft of one potentiometer and a bail coupling the control stick to the input shaft of the other potentiometer. There are no other connections between the control stick and the remainder of the assembly to bear loads exerted on the control stick. The bail furnishes mechanical stability to the control stick support because it is connected to the houusing of the assembly at two places on either side of the control stick. This eliminates the cantilever effect of the control stick support without substantially increasing the number of parts or design complexity.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
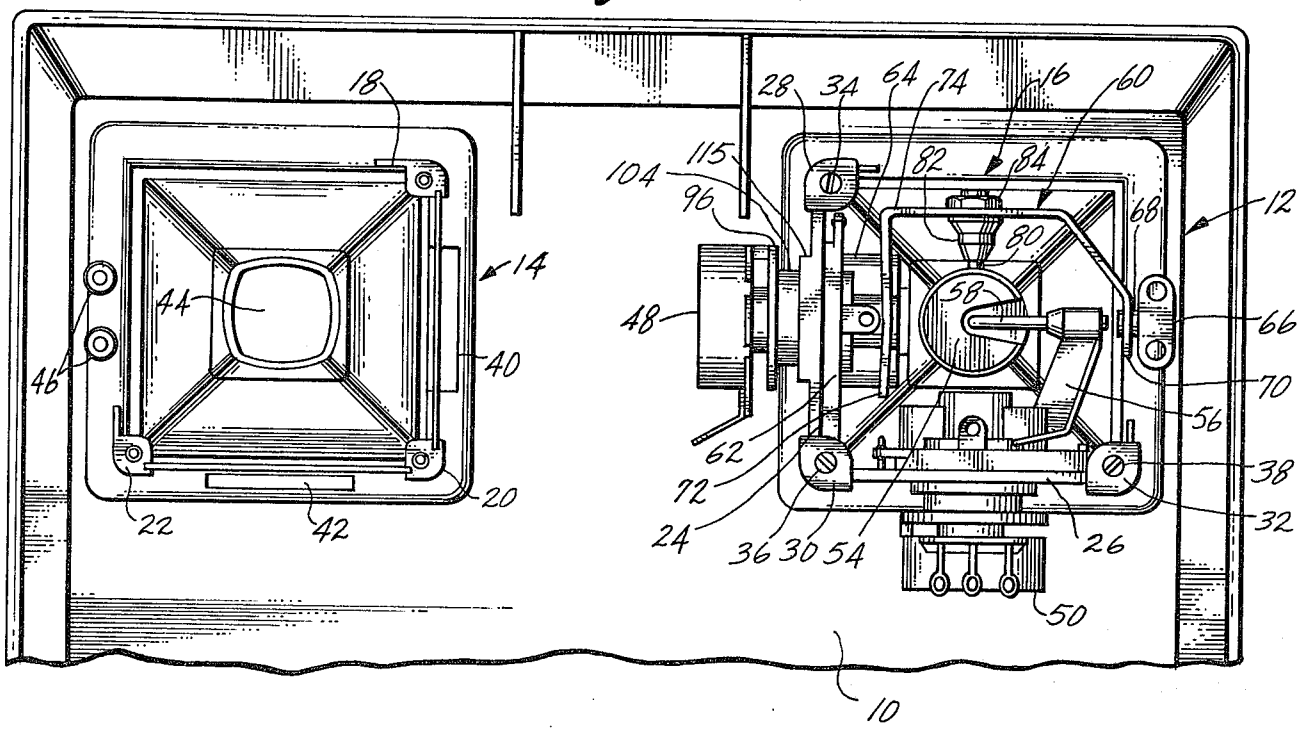
FIG. 1 is a bottom plan view of a control stick assembly incorporating the principles of the invention.

In FIG. 1, a control panel 10 has stations 12 and 14 for receiving control stick assemblies. A control stick assembly 16 is mounted at station 12. Likewise, a control stick assembly (not shown) would be mounted at station 14. At each station, mounting columns 18, 20, and 22 extend beneath panel 10. The facing sides of columns 18 and 20, the facings sides of columns 20 and 22, and the underside of panel 10 extending therebetween have grooves for receiving tongues in mounting plates 24 and 26. Plates 24 and 26 are retained between columns 18 and 20 and columns 20 and 22, respectively, by end caps 28, 30 and 32, and fasteners 34, 36, and 38. Trim control access slots 40 and 42 lie between, and slightly outboard of, columns 18 and 20, and 20 and 22, respectively. A truncated pyramidal recess 43 in panel 10 has a control stick access opening 44 at its apex. A pair of mounting posts 46 extends from the underside of panel 10 opposite slot 40.

Figure 2:
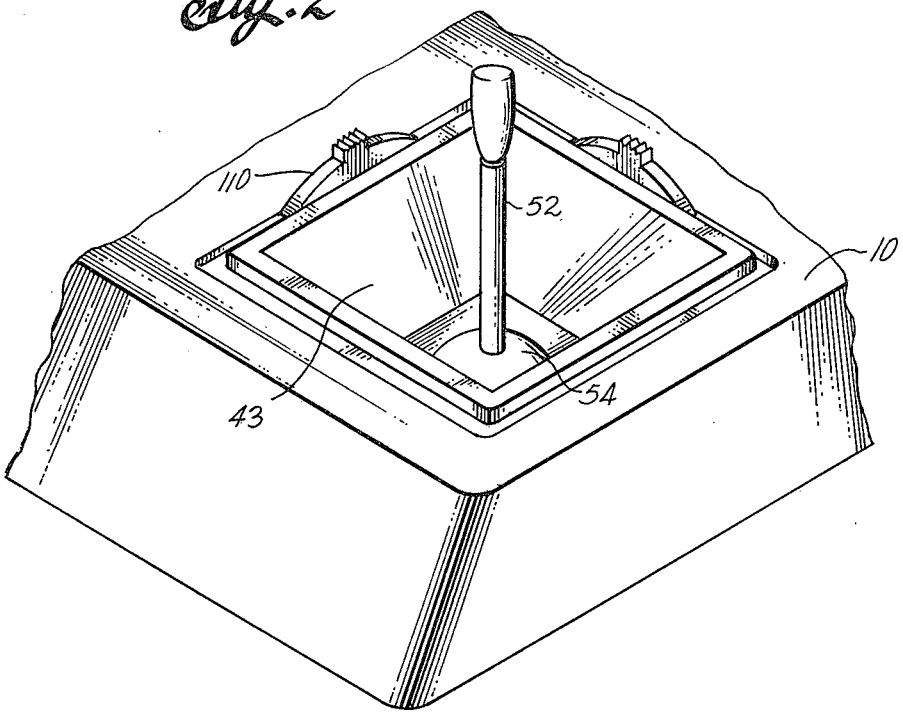
FIG. 2 is a perspective view of part of the top of the control stick assembly of FIG. 1.

Potentiometers 48 and 50 are mounted on plates 24 and 26, respectively, as described in more detail below for potentiometer 48 in connection with FIG. 2. One end of a control stick 52 is fixed to a ball 54. Ball 54 is located on the underside of panel 10 in closely spaced relationship from the edges of opening 44 and control stick 52 extends upwardly through opening 44 so as to be accessible from the top of panel 10. Control stick 52 is coupled to the input shaft of potentiometer 50 by a crank 56. Specifically, a connecting rod 58 extends parallel to the axis of rotation of the input shaft of potentiometer 48 from the end of crank 56 to ball 54. Rod 58 is fixed to ball 54 but is free to rotate and translate with respect to crank 56. Control stick 52 is coupled to the input shaft of potentiometer 48 by a bail 60. Specifically, a collar 62 having an oblong mounting shoulder or boss 64 facing toward ball 54 is secured on the end of the input shaft of potentiometer 48. A support member 66 having a cylindrical pin 68 facing ball 54 in alignment with the axis of rotation of the input shaft of potentiometer 48 is mounted on posts 46. Bail 60 has connecting portions 70 and 72, which extend perpendicular to the axis of rotation of the input shaft of potentiometer 48 at support member 66 and collar 62, respectively, and a yoke portion 74 extending between connecting portions 70 and 72. Connecting portion 70 has a circular opening 76 that receives pin 68 with a loose fit. Connecting portion 72 has an oblong opening 78 adpated to fit snugly over shoulder 64 of collar 62, where it is bonded in place. Because pin 80 is not fixed to connecting portion 70, care must be exercised to insure it is long enough to remain in opening 76 despite sideways movement of bail 60. A pin 80 is connected between ball 54 and yoke portion 74. One end of pin 80 is fixed to ball 54. The other end of pin 80 is free to rotate and translate within a sleeve 82 that is fixed to yoke portion 74 by a lock nut 84.

As control stick 52 is displaced so that ball 54 rotates about the axis of the input shaft of potentiometer 48, such rotation is transferred to the input shaft of potentiometer 48 by collar 62, bail 60, and pin 80, while connecting portion 70 of bail 60 rotates relative to pin 68 and rod 58 rotates relative to crank 56. A battery is connected across the end terminals of potentiometer 48 to produce between one end terminal and an intermediate terminal an electrical signal proportional to the rotational displacement of its input shaft.

As control stick 52 is displaced so that ball 54 rotates about the axis of the input shaft of potentiometer 50, such rotation is transferred to the input shaft of potentiometer 48 by crank 56 and rod 58, while rod 80 rotates with respect to bail 60. A battery is connected across the end terminals of potentiometer 50 to produce between one end terminal and an intermediate terminal an electrical signal proportional to the rotational displacement of its input shaft.

Complex displacement of control stick 52 is resolved into components along orthogonal axes coinciding with the axes of rotation of the input shafts of potentiometers 48 and 50 and electrical signals proportional to the components of this displacement are generated across the terminals of potentiometers 48 and 50.

There are no connections between control stick 52 and the remainder of the assembly, i.e., control panel 10, other than those through crank 56 and bail 60. This results in a reduction in the number of parts, vis-a-vis, a conventional two gimbal assembly. At all times, pin 68 and collar 62 support ball 54 and stick 52 through bail 60 by structurally what amounts to a simple beam rather than a cantilevered beam. Sleeve 82 provides rigidity to pin 80. Consequently, stick 52 and ball 54 are mechanically stable to the feel of the user, rather than giving a floating sensation.

Figure 4:
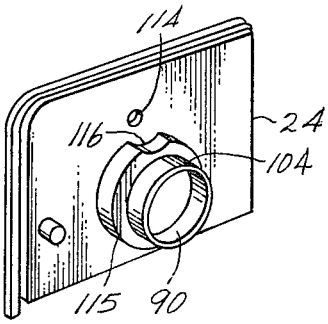
FIG. 4 is a perspective view of the other side of the mounting plate shown in FIG. 3.
Figure 3:
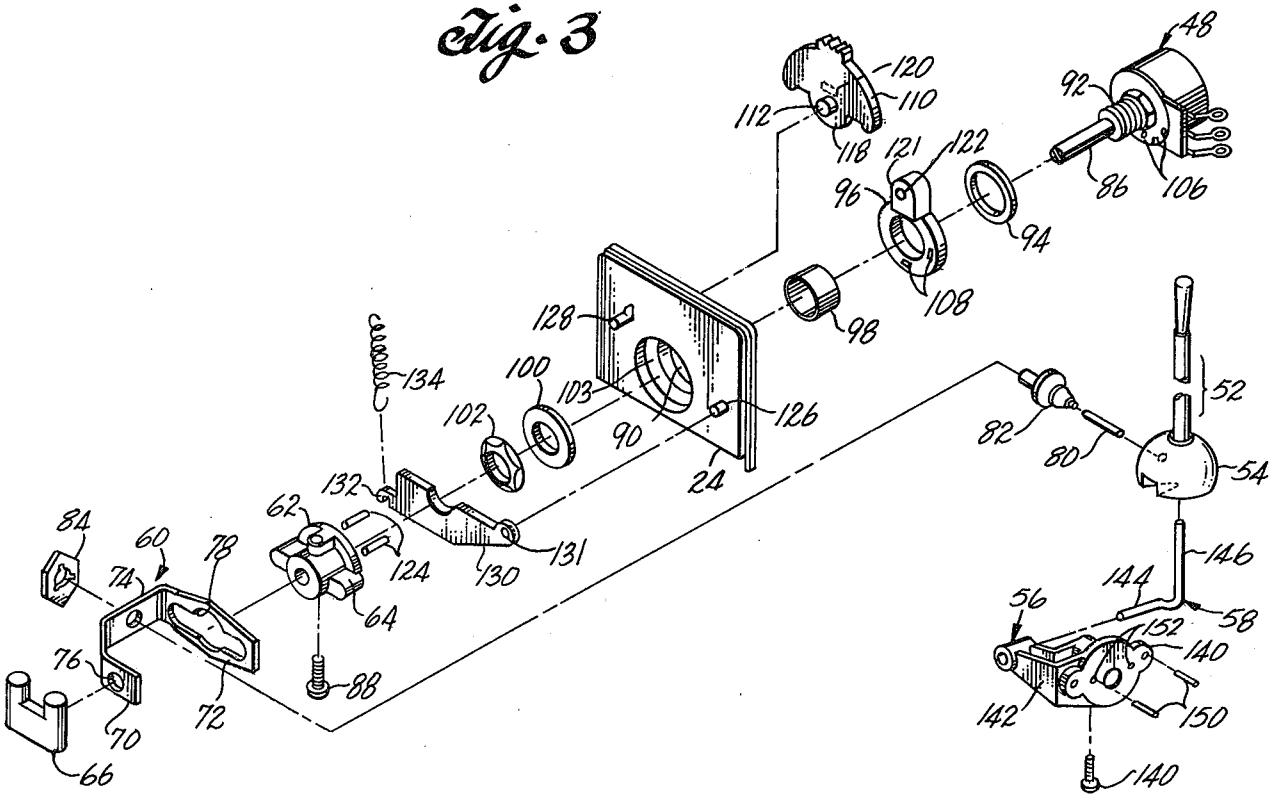
FIG. 3 is an exploded perspective view of the components associated with one axis of the control stick assembly and part of the other axis thereof.

In FIG. 3 the input shaft of potentiometer 48, which is represented by a reference numeral 86, passes through an opening 90 in plate 24 and is secured to collar 62 by a set screw 88. Input shaft 86 has a threaded boss 92 on which a washer 94, an annular coupling 96, a sleeve 98, a washer 100, and a nut 102 are mounted. Washer 100 and nut 102 lie in a recess 103 formed in the side of plate 26 facing away from potentiometer 48. When nut 102 is tightened, sleeve 98, which extends through coupling 96 and plate 24, serves as a spacer to prevent washers 94 and 100 from bearing too hard against coupling 96 and plate 24. Potentiometer 48 has a pair of tabs 106 that fit into openings 108 in coupling 96 so as to lock potentiometer 48 to coupling 96 with respct to rotation. Coupling 96 abuts the end of an annular spacer extension 104 (FIG. 4) of opening 90 facing toward potentiometer 48. A thumb wheel 110 for introducing trim adjustment, has a peg 112 that fits in a recess 114 (FIG. 4) on the side of plate 24 facing potentiometer 48. Thumb wheel 110 abuts the side of plate 24 facing potentiometer 48. Specifically, a ring 115 formed on the side of plate 24 facing potentiometer 48 around openig 90 has a circular relief 116 and the bottom of thumb wheel 110 has a matching circular portion 118, which permits thumb wheel 110 to rotate about peg 112. Thumb wheel 110 also has a peg 120 above peg 112 facing toward coupling 96. Coupling 96 has a protrusion 121 that abuts thumb wheel 110. In protrusion 121 is formed a recess 122 into which peg 120 fits. Thumb wheel 110 is held in place by relief 116 and protrusion 121. As thumb wheel 110 is turned in one direction of rotation about peg 112, peg 120 turns coupling 96 and with it potentiometer 48 in the other direction of rotation. Washers 94 and 100 and sleeve 98 provide a low friction supporting surface for boss 98 as potentiometer 48 rotates responsive to thumb wheel 110.

Collar 62 has a flat face from which a pair of pins 124 extends toward plate 24. Pins 124 are preferably press fit into bore holes in the flat face, the location of which determines the neutral position of the control stick for one axis. Pegs 126 and 128 are formed on the surface of plate 24 facing toward collar 62. A rocker arm 130 is disposed between plate 24 and collar 62. At one end, rocker arm 130 has an opening 131 into which peg 126 fits to permit rocker arm 130 to pivot away from input shaft 86, and at the other end rocker arm 130 has a hook 132. A spring 134 extends between hook 132 and peg 128 to bias the top edge of rocker arm 130 against both of pins 124. Spring 134 and rocker arm 130, acting through pins 124, provide a return force for control stick 52, when it is displaced in either direction from its upright, nuetral position, i.e., the postion perpendicular to the surface of panel 10. Specifically, when collar 62 rotates in one direction, one of pins 124 pivots rocker arm 130 away from input shaft 86, while the other pin pivots out of contact with rocker arm 130, thereby expanding spring 134; when collar 62 rotates in the other direction, the other pin pivots rocker arm 130 away from input shaft 86, while the first pin pivots away from rocker arm 130, thereby expanding spring 134.

The elements associated with potentiometer 50 are the same as those described in connection with potentiometer 48, except for crank 56. It has a locking collar base portion 140 the same as locking collar 62 and in addition a crank arm portion 142 that extends generally parallel to, but laterally displaced from, the axis of the input shaft of potentiometer 50. The input shaft of potentiometer 50 is secured to locking collar portion 140 by a set screw 140. A pair of pins 150, which function as pins 124, are press fit into bore holes 152. Rod 58 forms a right angle—a leg 144 extends from the end of the crank arm portion to ball 54 and a leg 146 fits into control stick 52, which is hollow.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention.

What is claimed is:

1. A control stick assembly comprising:

a first potentiometer having a first rotatable input shaft;

a second potentiometer having a second rotatable input shaft;

a control stick;

a crank connecting the control stick to the first input shaft to rotate same responsive to movement of the control stick along one axis; and a bail connecting the control stick to the second input shaft to rotate same responsive to movement of the control stick along an axis transverse to the one axis.

2. The assembly of claim 1, in which the crank has a base and an arm extending from the base laterally displaced from, but generally parallel to, the axis of the first input shaft to a point generally in alignment with the axis of the second input shaft, the base and arm having a one-piece construction, and a pin extending from the end of the arm to the control stick, the pin being fixed to the control stick and free to rotate and translate with respect to the crank arm.

3. The assembly of claim 2, in which the bail comprises a first connecting portion with an oblong opening, a second connecting portion with a circular opening, and a yoke portion between the first and second connecting portions, the assembly additionally comprising a locking collar secured to the second input shaft on one side of the control stick, the locking collar having an oblong boss that fits into the oblong opening, and a support member having a cylindrical peg axially aligned with the second input shaft on the other side of the control stick, the peg fitting loosely into the circular opening.

4. The assembly of claim 3, additionally comprising a pin fixed at one end to the control stick and attached at the other end to the yoke so as to be free to rotate with respect thereto.

5. The assembly of claim 4, additionally comprising a sleeve around the pin, the sleeve being fixed to the yoke, and the pin being free to rotate and translate within the sleeve.

6. The assembly of claim 5, additionally comprising a control panel and means for attaching the potentiometers to the control panel, the only connections of the control stick to the control panel being through the crank, bail, and potentiometers.

7. The assembly of claim 1, additionally comprising a control panel and means for attaching the potentiometers to the control panel, the only connections of the control stick to the control panel being through the crank, bail, and potentiometers.

8. A control stick assembly comprising:

a first potentiometer having a first rotatable inut shaft;

a second potentiometer having a second rotatable input shaft;

a control stick;

means including a lockig collar secured to the first input shaft for connecting the control stick to the first input shaft to rotate same responsive to movement of the control stick along one axis, the locking collar having a flat surface facing the first potentiometer;

means for connecting the control stick to the second input shaft to rotate same responsive to movement of the control stick along an axis transverse to the one axis;

a pair of pins extending from the flat surface of the locking collar toward the first potentiometer;

a pivotal rocker arm disposed adjacent to the flat surface of the locking collar; and spring means for biasing the rocker arm against both pins to provide a return force when the control stick is displaced in either direction about the axis of the first input shaft.

9. A control stick assembly comprising:

a first potentiometer having a first rotatable input shaft;

a second potentiometer having a second rotatable input shaft;

a control stick;

means for connecting the control stick to the first input shaft to rotate same responsive to movement of the control stick along one axis;

a potentiometer mounting plate;

means for attaching the first potentiometer to the plate such that the first potentiometer is rotatable with respect to the plate;

a ring formed on the side of the plate facing the first potentiometer;

a circular relief formed in the ring;

a trim introducing thumb wheel abutting the side of the plate facing the first potentiometer, the thumb wheel having a circular portion fitting in the relief to permit the thumb wheel to rotate relative to the ring;

a first peg on the thumb wheel extending away from the first potentiometer;

a second peg on the thumb wheel extending toward the first potentiometer;

a recess in the side of the plate facing the first potentiometer into which the first peg fits to permit rotation of the thumb wheel about the first peg; and a potentiometer coupling fixed to the potentiometer between the thumb wheel and the first potentiometer, the coupling having a recess into which the second peg fits to permit rotation of the potentiometer responsive to the thumb wheel.

10. The assembly of claim 9, in which the second peg is further away from the axis of rotation of the first potentiometer than the first peg.

* * * * *